US010375771B2

(12) United States Patent
Pin et al.

(10) Patent No.: US 10,375,771 B2
(45) Date of Patent: Aug. 6, 2019

(54) MICROWAVE HOUSEHOLD OR COMMERCIAL APPLIANCE

(71) Applicant: Electrolux Professional S.p.A., Pordenone (IT)

(72) Inventors: Gilberto Pin, San Vito al Tagliamento (IT); Alessandro Morassut, Sacile (IT); Mattia Pennasilico, Udine (IT)

(73) Assignee: Electrolux Professional S.p.A., Pordenone (IT)

( * ) Notice: Subject to any disclaimer, the term of this patent is extended or adjusted under 35 U.S.C. 154(b) by 475 days.

(21) Appl. No.: 15/178,790

(22) Filed: Jun. 10, 2016

(65) Prior Publication Data

US 2016/0366729 A1 Dec. 15, 2016

(30) Foreign Application Priority Data

Jun. 12, 2015 (EP) ..... 15171824

(51) Int. Cl.
*H05B 6/64* (2006.01)
*H05B 6/66* (2006.01)
(Continued)

(52) U.S. Cl.
CPC ..... *H05B 6/662* (2013.01); *G05F 5/00* (2013.01); *H05B 6/6426* (2013.01);
(Continued)

(58) Field of Classification Search
CPC ..... H05B 6/64; H05B 6/6402; H05B 6/642; H05B 6/6426; H05B 6/6482; H05B 6/662; H05B 6/664; H05B 6/666; H05B 6/68; H05B 6/681; H05B 6/683; H05B 6/685; H05B 6/725; H05B 6/80; H05B 2206/044; H05B 2206/046; G05F 5/00
(Continued)

(56) References Cited

U.S. PATENT DOCUMENTS 5,212,360 A * 5/1993 Carlson ..... H05B 6/68 219/760
2009/0272735 A1* 11/2009 Suenaga ..... H05B 6/685 219/702
2011/0062151 A1* 3/2011 Tassan-Mang-Ina ..... A47J 37/0611 219/690

FOREIGN PATENT DOCUMENTS

EP 1954098 A1 8/2008
EP 2023690 A1 2/2009
JP 2007149444 A 6/2007

OTHER PUBLICATIONS

European Search Report issued in corresponding European Patent Application No. 15171824.4 dated Nov. 25, 2015, 7 pages.

* cited by examiner

*Primary Examiner* — Hung D Nguyen
(74) *Attorney, Agent, or Firm* — Pearne & Gordon LLP

(57) ABSTRACT

A household or commercial appliance includes a couple magnetrons having relative anodes and cathodes, and a power unit comprising a high voltage circuit. The high voltage circuit comprises: a high voltage transformer comprising a primary winding connected to an alternating voltage source and a secondary high-voltage winding providing an alternating high voltage having a period comprising two half periods, a couple of half-wave voltage doubler circuits, and first and second unidirectional conducting devices. The first and second unidirectional conducting devices being configured to cause the half-wave voltage doubler circuits to supply, during a period of the alternating high-voltage the doubled high-voltage to the cathode of the respective magnetron alternately.

15 Claims, 8 Drawing Sheets

(51) Int. Cl.
*H05B 6/68* (2006.01)
*H05B 6/80* (2006.01)
*G05F 5/00* (2006.01)

(52) U.S. Cl.
CPC ..... *H05B 6/6482* (2013.01); *H05B 6/664* (2013.01); *H05B 6/666* (2013.01); *H05B 6/683* (2013.01); *H05B 6/80* (2013.01); *H05B 2206/044* (2013.01); *H05B 2206/046* (2013.01)

(58) Field of Classification Search
USPC ..... 219/680, 681, 685, 702, 711, 715, 717, 219/718, 760
See application file for complete search history.

MICROWAVE HOUSEHOLD OR COMMERCIAL APPLIANCE

The present invention concerns the field of microwave heating, and in particular to a microwave heating household or commercial heating appliance which is provided with a high voltage control circuit designed to power-on one or more couple of magnetrons irradiating microwaves inside to a heating chamber (e.g. a cooking chamber or a drying chamber or a washing chamber).

BACKGROUND ART

As it is known, many household and commercial appliances comprise a heating chamber. The working principle of the heating chamber depends on the kind of appliances. In some kind of appliances, like for example laundry drying machines (called also laundry driers), the heating chamber is structured to accommodate laundry to be dried, whereas in other kind of appliances, like for example microwave ovens, the heating chamber is structured to accommodate the food to be heated/cooked.

It is understood that in the present application with "commercial appliance" or "professional appliance" it is meant an appliance which is not designed to be used for "domestic" activities (even if theoretically it could be used also for domestic activities), but it is designed specifically to be used in commercial/professional activities such as, for example, restoration activities (restaurants, pubs, hotels), public service laundry (self-service laundry), or the like.

Some kind of known small commercial/professional cooking/heating appliances, generally called combined cooking appliances, comprises a number of different heating sources, such as microwaves generators, resistive heating means, and infrared radiation generating means. In use, the heating sources of the appliance are activated individually or in combination on the basis of the selected cooking/heating program, in order to perform quick cooking/heating of food products, especially sandwiches, toasts, hamburgers, met in general or the like.

Said commercial/professional cooking/heating appliances generally comprise a base member associated to a bottom heating surface designed to support food products to be cooked/heated, an upper member associated to a top heating surface and joined in an articulated manner to the base member in order to be tilted around an horizontal axis from an open position and a closed position, wherein the upper member is displaced towards the base member and the top heating surface comes to lie opposite to the bottom heating surface so as to enclose the food products therebetween.

The upper member is structured in order to close in onto the base member so as to form a cooking/heating cavity or chamber containing said heating surfaces. The base member comprises a microwave generator designed to irradiate the food products being enclosed between said heating surfaces, wherein the cooking/heating chamber defines a radiation shield or choke-frame designed to confine the microwaves radiation inside said cooking/heating chamber when the upper member is in the closed position.

To reach the fast cooking-time specifications, said combined cooking/heating appliances need to generate a high power density in the cooking/heating chamber. To this end, combined cooking/heating appliances are generally provided with two microwaves generators, i.e. two magnetrons which are generally placed in the base member below the food-support surface, and a high voltage control circuit which is configured to supply a high direct current (DC) voltage to the cathodes of said magnetrons.

Some kind of known high voltage control circuits of said combined cooking/heating appliances comprise two separate high voltage transformers and two rectifier circuit, each of which rectifies the alternate high voltage boosted by the respective high voltage transformer in order to supply the high direct voltage (or direct current D.C.) to the relative magnetron.

This solution has the drawbacks that said two high voltage transformers are weighty, bulky and heavily affect the overall cost of the appliance.

With the aim to overcome such problems, a solution is known wherein the high voltage control circuit comprises a single high voltage transformer which supplies both the magnetrons by using two relative half-wave voltage doubler circuits. The half-wave voltage doubler circuits are connected to the secondary high-voltage winding of the high voltage transformer, one in phase with respect to the other, in order that input terminals of both half-wave voltage doubler circuits have equal polarities during each half-period of the high-voltage.

In detail, half-wave voltage doubler circuits are connected in parallel to each other between a common terminal of the secondary high-voltage winding of the high voltage transformer and cathodes of the magnetrons and are configured to boosts and rectifies the high-voltage generated by the secondary high-voltage winding in order to provide a doubled high voltage to the magnetrons, respectively. The circuit structure and working of a half-wave voltage doubler circuit is disclosed, for example, in paragraph 7.6.1. of the book titled "THE COMPLETE MICROWAVE OVEN SERVICE HANDBOOK OPERATION MAINTENANCE TROUBLESHOOTING AND REPAIR" written by J. Carlton Gallawa.

In use, during the half-periods of the high alternating voltage, half-wave voltage doubler circuits operate "in phase" one to the other. More specifically, half-wave voltage doubler circuits are switched-on together during first half-periods of the high alternating voltage (for example during the positive half-waves), and they are switched-off together during second half-cycles (for example during the negative half-waves).

Thus, during the first half-cycles, the high voltage control circuit provides a maximum high power, which is substantially the sum of the in-phase magnetrons powers, whereas during the second half-cycles, the power provided to the heating chamber is zero as the half-wave voltage doubler circuits are switched-off.

However, supplying both magnetron powers simultaneously during the first half-cycles results in a too high power density, having very high undesirable power peaks inside of the cooking chamber.

Although this solution allows using a small transformer having less copper and laminated iron cores of smaller cross sectional area than the solution with two transformers, it has the drawback that the choke cover, in particular in case of few amount of food loaded in the cooking/heating chamber, can be subjected to electrical discharges due to said power peaks.

Indeed, the cooking/heating chamber of the combined cooking/heating appliances is quite small, thus the generated high power peaks produce localized high electric fields inside the chamber, in particular in correspondence of the choke cover. This may cause electrical discharges across the choke cover and high power losses due to eddy currents. Furthermore, the electrical discharges are further increased in the chamber by electrically conductive pollutants, e.g. food remains, water and may eventually lead to flashing.

Voltage doublers providing full-wave rectification for a single magnetron are also known from literature, but require many electronic components, thus they are not used in practice because too expensive.

The Applicant has conducted an in-depth study with the objective of providing a household or commercial heating appliances comprising a high voltage control circuit supplying high voltage to at least a couple of magnetrons, which is simple and cheap and is able to reduce the peaks in the power density and consequently the risk of electrical discharges in the choke cover, in the waveguides and in the heating chamber. It is thus the object of the present invention to provide a solution which allows achieving the objectives indicated above.

DISCLOSURE OF INVENTION

According to the present invention, there is provided a household or commercial appliance comprising: a heating chamber designed to accommodate a food product to be heated, at least a couple of magnetrons having relative anodes and cathodes and being configured to generate and irradiate electromagnetic radiations in the heating chamber at least a power unit comprising at least a high voltage circuit configured to power-on said magnetrons, the high voltage circuit comprises: a high voltage transformer comprising a primary winding connected to an alternating voltage source and at least a secondary high-voltage winding providing an alternating high voltage having a period comprising two half periods, at least a couple of half-wave voltage doubler circuits which are configured to cooperate with said secondary high-voltage winding in order to provide a doubled high-voltage, at least a first and second unidirectional conducting devices which are connected respectively between said half-wave voltage doubler circuits and a reference terminal having a predetermined potential, said first and second unidirectional conducting devices being configured to cause said half-wave voltage doubler circuits to supply, during at least a period of said alternating high-voltage, said doubled high-voltage to the cathode of the respective magnetron alternately, one of said half-wave voltage doubler circuits supplying said doubled high-voltage during one of said half periods of said alternating high-voltage, and the other half-wave voltage doubler circuit supplying said doubled high-voltage during the other half-period of said alternating voltage.

Advantageously the magnetrons are configured to generate and irradiate electromagnetic radiations in the heating chamber directly or through dedicated waveguides.

Preferably, the half-wave voltage doubler circuits comprise two respective high voltage capacitors; the first and second unidirectional conducting devices being configured to cause the high voltage capacitors to be alternately charged; one high voltage capacitor being supplied during one of said half periods and the other voltage capacitor being supplied during the other half-period.

Preferably, a first high voltage capacitor of a first half-wave voltage doubler circuit has a first terminal connected through a first junction to a first terminal of the secondary high-voltage winding and a second terminal connected through a second junction to the cathode terminal of a first magnetron; a second high voltage capacitor of the second half-wave voltage doubler circuit has a first terminal connected through a third junction to a second terminal of the secondary high-voltage winding, and a second terminal connected through a fourth junction to the cathode terminal of the second magnetron (8*b*).

Preferably, the first half-wave voltage doubler circuit further comprises a third unidirectional conducting device, which has an anode terminal connected to the second junction and a cathode terminal which is connected through a fifth junction to said second terminal of the secondary high-voltage winding; the second half-wave voltage doubler circuit further comprises a fourth unidirectional conducting device, which has an anode terminal connected with the fourth junction and a cathode terminal which is connected through a sixth junction with said first terminal of the secondary high-voltage winding.

Preferably, the first unidirectional conducting device has an anode terminal connected to the fifth junction and a cathode terminal connected to said reference terminal being kept at said predetermined potential; the second unidirectional conducting device has an anode terminal connected to the sixth junction and a cathode terminal connected to said reference terminal being kept at said predetermined potential.

Preferably, the first unidirectional conducting devices and the fourth unidirectional conducting device are configured to be conducting during first half-periods of said alternating high-voltage, in order to cause, during said first half-periods, the second high voltage capacitor of the second half-wave voltage doubler circuit to be charged to the amplitude of said alternating high-voltage, and a double voltage between the second junction and fifth junction to be supplied to the first magnetron.

Preferably, the second unidirectional conducting devices and the third unidirectional conducting device are configured to be conducting during second half-periods of said alternating high-voltage, in order to cause, during said second half-periods, the first high voltage capacitor of the first half-wave voltage doubler circuit to be charged to the amplitude of said alternating high-voltage, and the double voltage between the fourth junction and sixth junction to be supplied to the second magnetron.

Preferably, the high voltage control circuit comprises: at least a first and a second current sensing devices, which are configured to provide respective electric signals indicative of the charging status of the second capacitor and first capacitor respectively; a control unit configured in order to: receive the electric signals, determine the charging status of the second and of the first capacitor based on the received electric signals, and diagnose/detect whether first magnetron and/or the second magnetron are correctly supplied with the doubled high voltage based on determined charging status of the first capacitor and second capacitor.

Preferably, the first current sensing device is connected in series to the first unidirectional conducting device in order to measure/sense the current that flows from the third junction to the reference terminal during a first half-cycle of said alternating high-voltage, and outputs said electric signal indicating the measured current; a second current sensing device is connected in series to the second unidirectional conducting device in order to measure/sense the current that flows from the first junction to the reference terminal during a second half-wave of said alternating high-voltage, and outputs said electric signals indicating the measured current.

Preferably, the high voltage control circuit comprises at least an over-current protecting device, which is connected between said first terminal of the secondary high-voltage winding and said first junction, or between the second terminal and said third junction.

In an advantageous embodiment, the appliance comprises two or more (preferably two or three) couples of magnetrons having relative anodes and cathodes and being configured to generate and irradiate electromagnetic radiations in the cooking/heating chamber; in this advantageous embodiment the power unit comprises two or more (preferably two or three) high voltage circuits each being configured to power-on the two magnetrons of one of said two or more couples of magnetrons alternately to each other.

Preferably, the appliance comprises a base member comprising a food-support surface, which is adapted to support food products to be cooked/heated and an upper member associated to a top heating surface and joined in an articulated manner to the base member in order to be tilted/rotate around an horizontal axis from an open position and a closed position, wherein the upper member is displaceable towards the base member and the top heating surface comes to lie opposite to the food-support surface so as to enclose the food products therebetween.

Preferably, the appliance comprises: infrared radiation generating devices configured to generate and irradiate, on command, infrared radiation in the heating chamber across the food-support surface, resistive heating devices configured to heat, on command, said top heating surface.

Preferably, the appliance comprises a control unit configured to control the microwaves generators, the resistive heating devices and the infrared radiation generating devices based on a coking program selected by a user by means of a control panel.

Preferably, the half-wave voltage doubler circuits are connected to said secondary high-voltage winding, one in counter phase with respect to the other.

Preferably, the appliance comprises an external casing, a cooking/heating chamber arranged inside of the external casing and a front door mechanically coupled with the external casing in order to rotate around a vertical axis between an open position, which allows the access to the cooking/heating chamber, and a closed position wherein the front door closes the cooking/heating chamber.

In a further advantageous embodiment, the household or commercial appliance is a microwave laundry drier, comprising a casing resting on a floor on a number of feet. Casing preferably supports a revolving laundry drum which defines a heating chamber, which in this case is a drying chamber, rotates about a horizontal rotation axis (in alternative embodiments rotation axis may be tilted or vertical), and has a front access opening closed by a door, preferably hinged to a front wall of casing.

Drum is preferably rotated by an electric motor, and is fed through with a stream of drying air fed into drum by a ventilation system.

Advantageously, microwave laundry drier comprises a microwave energy source for directing microwave energy to drying chamber.

Microwave energy source is advantageously fixed to a front panel, which is supported by casing and has a central opening coaxial to front access opening of drying chamber. Microwave energy source advantageously comprises two couples of magnetrons preferably arranged symmetrically around central opening in said front panel and advantageously fixed (preferably screwed) to a back of front panel to prevent microwave leakage inwards of casing.

Each magnetron has preferably a magnetron antenna which emits the microwave energy and is located outside casing through a hole in front panel.

Microwave energy source preferably comprises, for each magnetron, a waveguide device to guide the microwaves towards drying chamber.

Each waveguide device preferably also comprises a deflector, which is supported by door and is designed to direct the microwaves towards drying chamber.

In the preferred embodiment, an air intake conduit is connected to microwave energy source so that at least part of the drying air flows past microwave energy source to transfer heat from microwave energy source to the drying air.

Microwave laundry drier preferably comprises an annular reflecting element surrounding central opening in front panel to form a microwave barrier.

In another advantageous embodiment, the household or commercial appliance is a laundry washing machine; in this case the heating chamber is advantageously a washing tub comprising a rotatable drum in which the laundry is loaded. The washing tub is advantageously arranged for receiving washing/rinsing water, and one or more couple of magnetrons according to the invention are provided in order to heat the washing/rinsing water and/or directly the laundry contained in the rotatable drum.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF THE INVENTION

The high voltage control circuit of the present invention has proved to be particularly advantageous when applied to a "combined" appliance for cooking/heating food products, wherein the food in the cooking/heating chamber may be cooked/heated by means of at least a couple of microwaves generators individually, or in addition with other kind of heating devices, such as for example, resistive heating generators and infrared radiation generators.

However, it should be understood that although the high voltage control circuit is described with reference to the combined appliances for cooking/heating food products, other applications are contemplated. As can be appreciated, the present invention can be conveniently applied to other kind of household or commercial appliance, such as e.g. conventional household microwave oven (not illustrated) having an external casing, a heating chamber arranged inside of the external casing and a front door mechanically coupled with the external casing in order to rotate around a vertical axis between an open position, which allows the access to the heating chamber, and a closed position wherein the front door closes the heating chamber.

Figure 1:
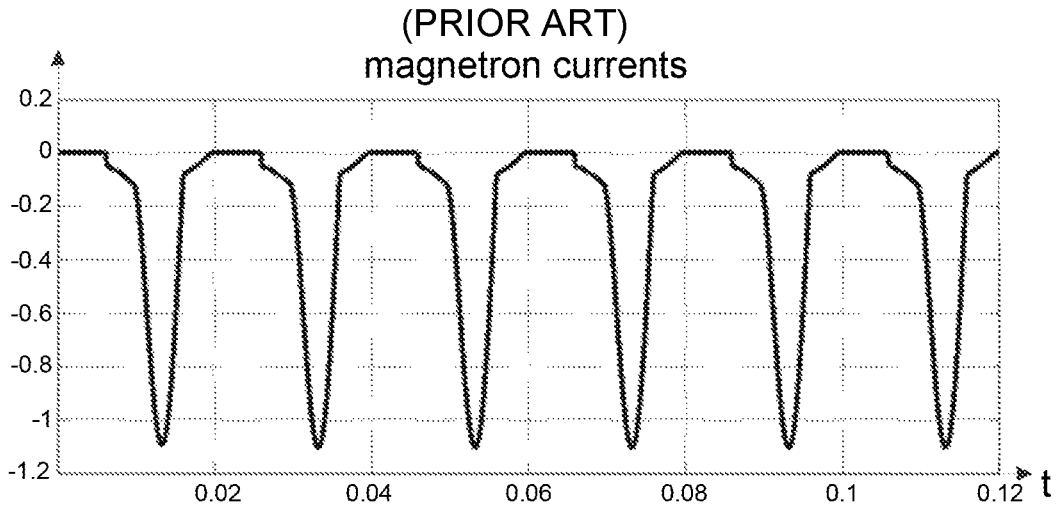
FIG. 1 is a graph illustrating the time variation of currents supplied to a couple of magnetrons included in a prior-art professional microwave cooking/heating appliance.
Figure 2:
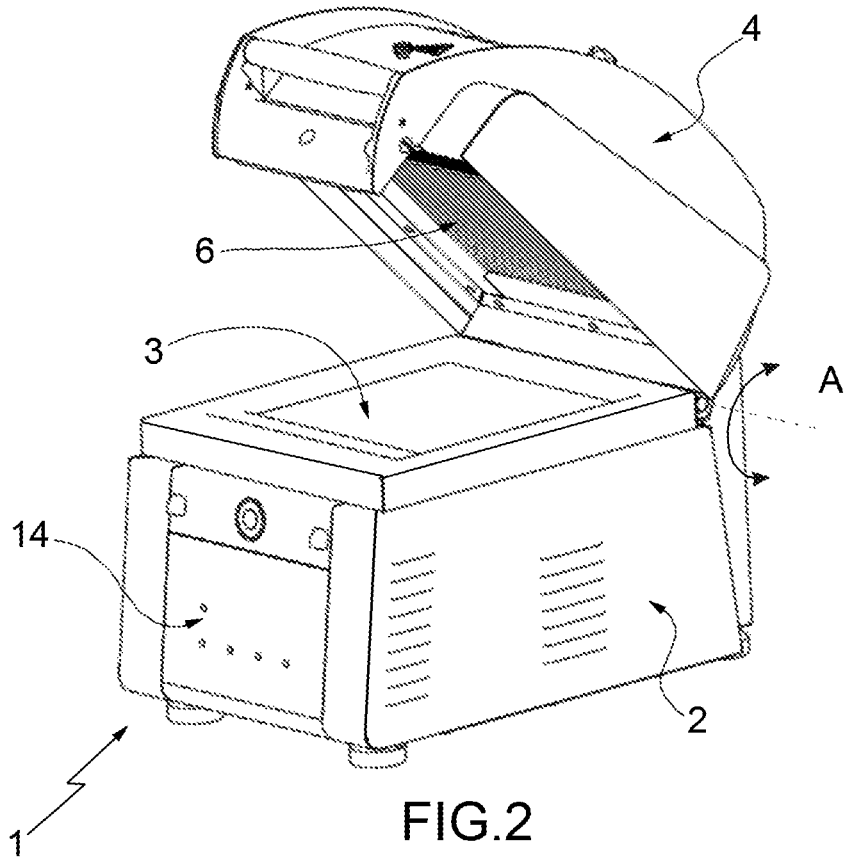
FIG. 2 is a prospective view of a household or commercial appliance corresponding to a professional microwave food cooking/heating appliance made according to the present invention.
Figure 3:
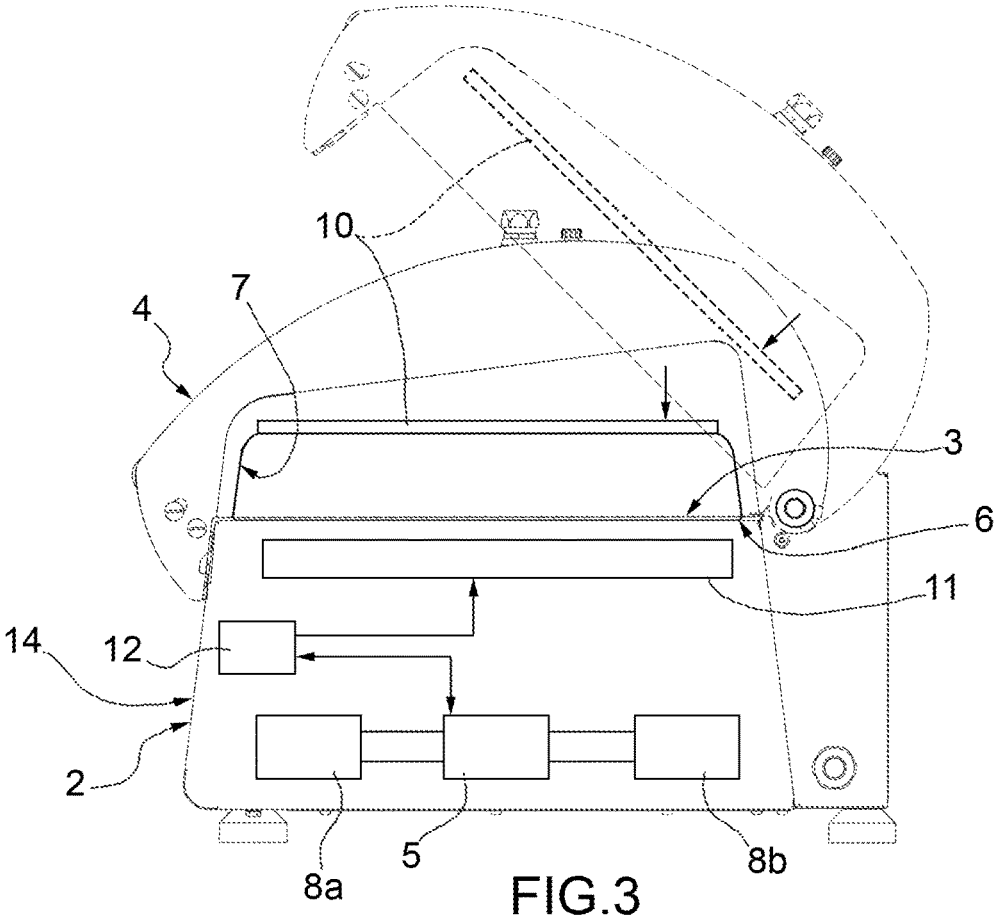
FIG. 3 is a schematic cross section with parts removed for clarity of the appliance illustrated in FIG. 2.

An advantageous embodiment of a household or commercial appliance according to the invention is shown in FIGS. 2 and 3; in this advantageous embodiment the household or commercial appliance is a microwave food cooking/heating appliance 1 such as a household or commercial/professional combined food heating appliance, which is adapted to quickly cook/heat food products by means of at least microwave radiations. With reference to the advantageous embodiment illustrated in FIG. 2, the food cooking/heating appliance 1 is preferably provided with: a base member 2 comprising a food-support surface 3, which is adapted to support food products to be heated/cooked and an upper member 4 preferably associated to a top heating surface 6 and joined preferably in an articulated manner to the base member 2 in order to be tilted/rotate around an horizontal axis A from an open position (illustrated in FIG. 2, and in FIG. 3 with broken lines) and a closed position (illustrated in FIG. 3 with continue lines) wherein the upper member 4 is displaced towards the base member 2 and the top heating surface 6 comes to lie opposite to the food-support surface 3 so as to enclose the food products therebetween.

With reference to a preferred embodiment illustrated in FIG. 3, the upper member 4 is structured in order to close in onto the base member 2 so as to form a cooking/heating chamber 7 containing said heating surfaces.

With regards to the exemplary embodiment illustrated in FIG. 2, the cooking/heating appliance 1 further comprises at least a couple of microwaves generators, preferably at least a couple of magnetrons 8*a*, 8*b*, which may be arranged preferably into an inner compartment of the base member 2 below the food-support surface 3, and are advantageously connected to waveguide cavities (not illustrated) to generate and irradiate microwave radiations in the cooking/heating chamber 7, advantageously when the upper member 4 is placed in the closed position.

The cooking/heating appliance 1 further preferably comprises: an electrical power unit 5 provided with a high voltage control circuit 9 configured to supply high voltage to the magnetrons 8*a* 8*b*, as hereinafter disclosed in detail, and preferably, although not necessarily, resistive heating devices 10 configured to heat, on command, the top heating surface 6 (if advantageously provided). The electrical power unit 5 may also advantageously comprise infrared radiation generating devices 11 configured to generate and irradiate, on command, infrared radiation in the heating chamber 7 across the food-support surface 3.

The electrical power unit 5 may also advantageously comprise an electronic control unit 12 configured to control the magnetrons 8*a* and 8*b*, the resistive heating devices 10 (if advantageously provided) and the infrared radiation generating devices 11 (if advantageously provided), preferably based on a coking program selected by a user by means of a control panel 14.

The base member 2, the upper member 4, the heating chamber 7, the food-support surface 3, the top heating surface 6, the resistive heating devices 10 and the infrared radiation generating devices 11 will not be further described, being preferably made according to the description of the European Patent Application EP 2 063 686 B1 filed by the same Applicant, which is hereby incorporated by reference.

Figure 4:
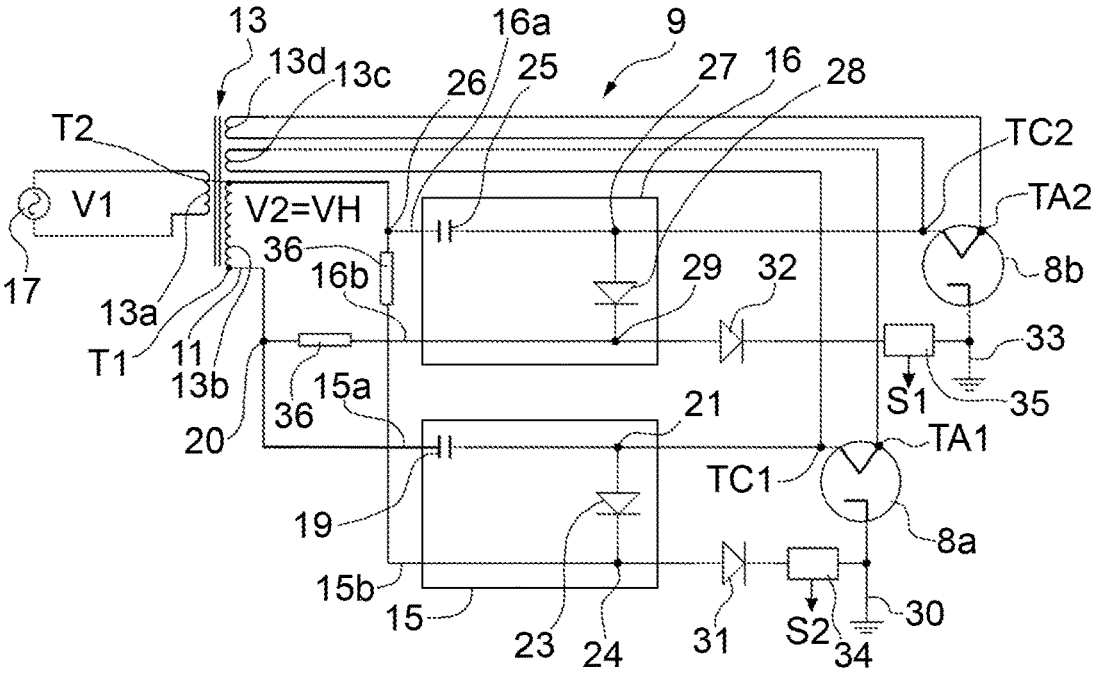
FIG. 4 illustrates schematically a high voltage control circuit supplying high voltage to a couple of magnetrons installed in an appliance according to the invention.
Figure 5:
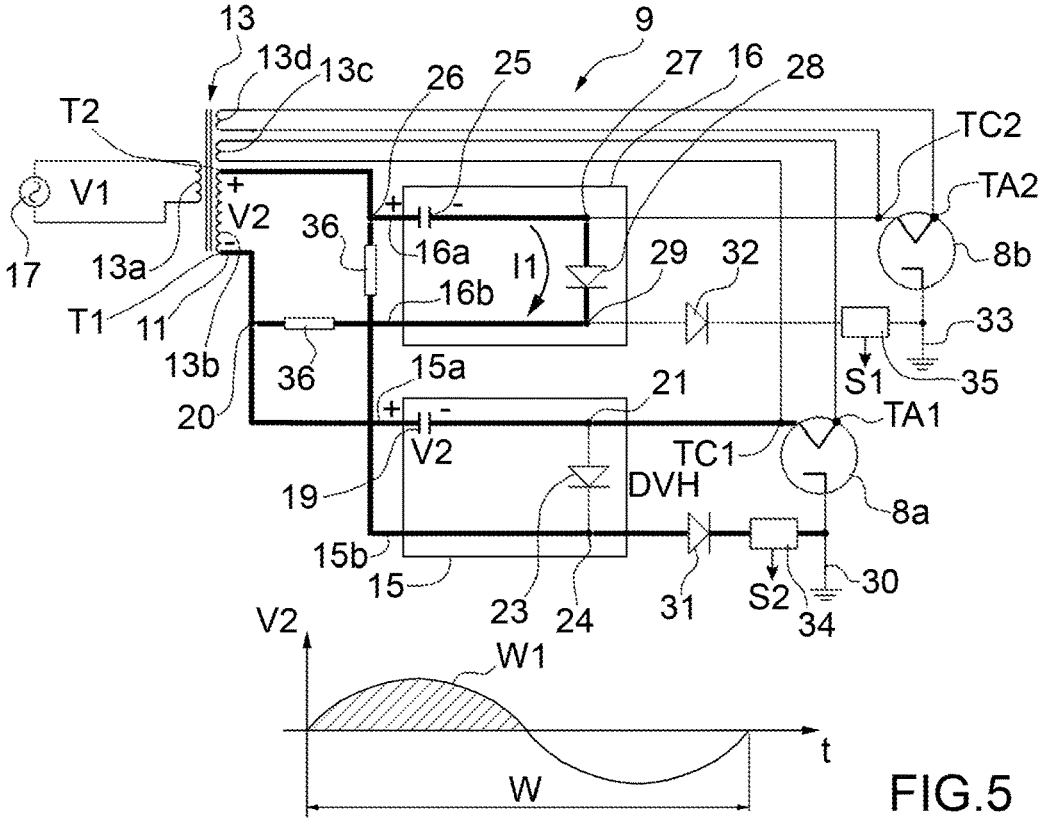
FIG. 5 illustrates the operating of the high voltage control circuit during a first half-period of an alternating high voltage provided by the high voltage transformer of the high voltage control circuit.
Figure 6:
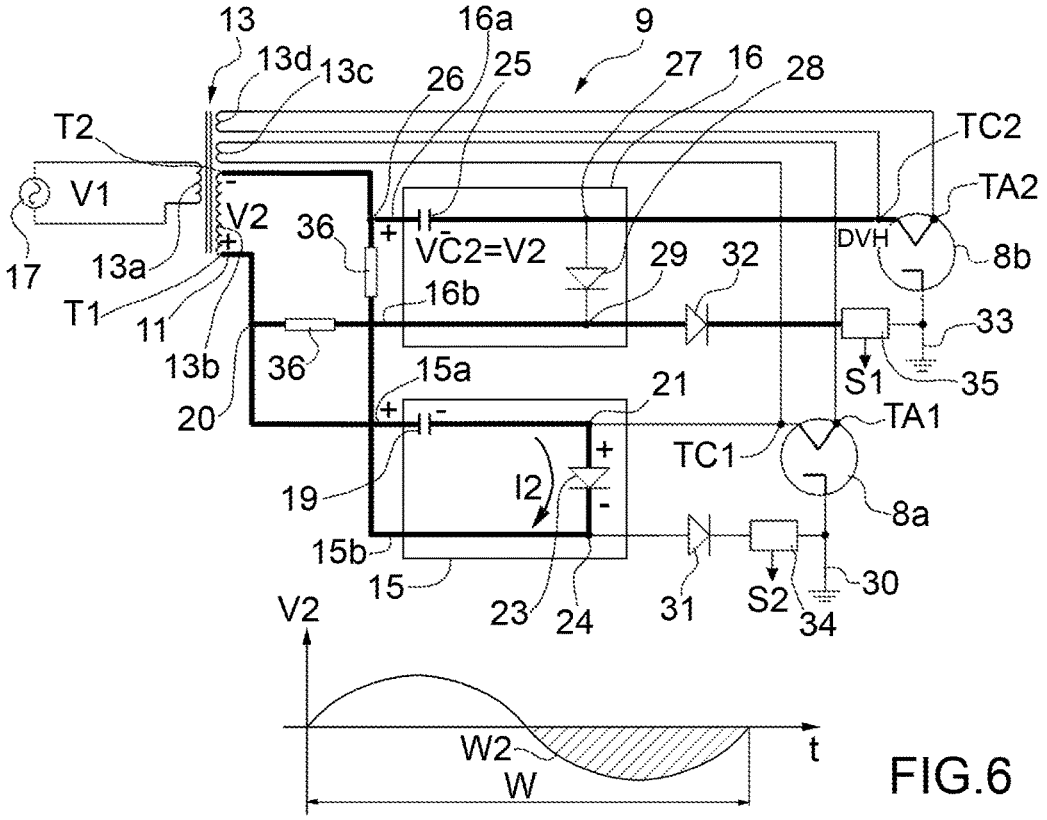
FIG. 6 illustrates the operating of the high voltage control circuit during a second half-period of an alternating high voltage provided by a high voltage transformer of the high voltage control circuit.

With reference to a preferred embodiment illustrated in FIG. 4, the high voltage control circuit 9 is advantageously configured to supply high voltages to the magnetrons 8*a* and 8*b* alternately, on the basis of the half-periods of a main high voltage. Thus, as will be disclosed in detail hereinafter, the high voltage control circuit 9 is conveniently adapted to energize the magnetron 8*a* during one half-period of the alternating high voltage and, alternately, energize the other magnetron 8*b*, during the other half-period. With reference to a preferred embodiment illustrated in FIG. 4, the high voltage control circuit 9 comprises a high-voltage transformer 13 comprising: a primary winding 13*a* connected to an alternating voltage source 17 to receive an alternating main voltage V1, and a secondary high-voltage winding 13*b*, which comprises a first terminal T1 and a second terminal T2 providing an alternating high voltage V2 therebetween. With reference to FIGS. 5 and 6 the alternating high voltage V2 has a period W comprising two half-periods hereinafter indicated with W1 and W2.

The high-voltage transformer 13 may further comprise a first low-voltage winding 13*c* which provides an alternating low voltage between a cathode terminal TC1 and an anode terminal TA1 of the first magnetron 8*a* in order to power-on a resistive filament connected between said terminals, and a second low-voltage winding 13*d* which provides an alternating low voltage between cathode terminal TC2 and the anode terminal TA2 of the second magnetron 8*b* in order to power-on a resistive filament connected between said terminals.

The high voltage control circuit 9 further comprises a first half-wave voltage doubler circuit 15, which is configured to cooperate with the secondary high-voltage winding 13*b* as will be disclosed in detail hereinafter, in order to supply a doubled high-voltage DVH=V2+V2 to the cathode terminal TC1 of the first magnetron 8*a*, and a second half-wave voltage doubler circuit 16 which is configured to cooperate with the secondary high-voltage winding 13*b*, as will be disclosed in detail hereinafter, in order to supply the doubled high-voltage DVH to the cathode terminal TC2 of the second magnetron 8*b*.

With reference to the exemplary embodiment illustrated in FIG. 4, the first half-wave voltage doubler circuit 15 comprises a first terminal 15*a* connected through a junction 20 to the first terminal T1 of the secondary high-voltage winding 13*b*, and a second terminal 15*b* connected through a junction 21 to the cathode terminal TC1 of the first magnetron 8*a*.

The first half-wave voltage doubler circuit 15 further comprises a second terminal 15*b* which is connected through a junction 26 to the second terminal T2 of the secondary high-voltage winding 13*b*.

The first half-wave voltage doubler circuit 15 advantageously comprises a high voltage capacitor 19 which has a first terminal connected with to the first terminal 15*a*, and the second terminal connected through a junction 21 to the cathode terminal TC1 of the first magnetron 8*a*.

The first half-wave voltage doubler circuit 15 further comprises an unidirectional conducting device 23, e.g. a diode, which has the anode connected to the junction 21 and the cathode which is connected through a junction 24 to the second terminal 15*b*. With reference to the exemplary embodiment illustrated in FIG. 4, the second half-wave voltage doubler circuit 16 comprises a first terminal 16*a* connected through a junction 26 to the second terminal T2 of the secondary high-voltage winding 13*b* and a second terminal 16*b* connected through a junction 20 to the first terminal T1 of the secondary high-voltage winding 13*b*.

The second half-wave voltage doubler circuit 16 advantageously comprises a high voltage capacitor 25 which has a first terminal connected to the first terminal 16*a* and a second terminal connected through a junction 27 to the cathode terminal TC2 of the second magnetron 8*b*.

The second half-wave voltage doubler circuit 16 advantageously comprises an unidirectional conducting device 28, e.g. a diode, which has the anode connected with the junction 27 and the cathode which is connected through a junction 29 with the second terminal 16*b*.

With reference to the exemplary embodiment illustrated in FIG. 4, the high voltage control circuit 9 further advantageously comprises an unidirectional conducting device 31, e.g. a diode, which has the anode connected to the junction 24 and the cathode connected to a terminal 30 being kept at a predetermined potential, e.g. ground potential VGND.

The high voltage control circuit 9 further advantageously comprises an unidirectional conducting device 32, e.g. a diode, which has the anode connected to the junction 29 and the cathode connected to a terminal 33 being kept at a predetermined potential, e.g. ground potential VGND.

The unidirectional conducting devices 28 and 31 are configured to cause said half-wave voltage doubler circuits 15 and 16 to supply, during at least a period W of the alternating high-voltage V2, the doubled high-voltage DVH to the cathodes TC1 and TC2 of the respective magnetrons 8*a* and 8*b* alternately.

According to the present invention, one of the half-wave voltage doubler circuits 15 advantageously supplies the doubled high-voltage DVH to the magnetron 8*a* during one half period W1, and the other half-wave voltage doubler circuit 16 supplies the doubled high-voltage DVH to the magnetron 8*b* during the other half-period W2 of the alternating high voltage V2 as will be better explained in the following.

With reference to the exemplary embodiment illustrated in FIG. 4, the half-wave voltage doubler circuits 15 and 16 are connected to the secondary high-voltage winding 13*b* one in "counter phase" with respect to the other.

In the exemplary embodiment illustrated in FIG. 4, the terminals 15*a* and 15*b* of the half-wave voltage doubler circuit 15 and the terminals 16*a* and 16*b* of the half-wave voltage doubler circuit 16 are connected to first terminal T1 and the second terminal T2, one in counter phase with respect the other, in such a way that, in use, during a half-period of the high voltage V2, the terminals 15*a* and 15*b* of the half-wave voltage doubler circuit 15 are poled opposite to the terminals 16*a* and 16*b* of the half-wave voltage doubler circuit 16 and during the next half-period, voltage polarities of any couple of terminals 15*a*, 15*b* and 16*a*,16*b* are inverted, compared to the previous ones. With reference to FIGS. 5 and 6, because the counter phase connection, during a half period, the alternating high-voltage V2 is supplied to terminals 15*a* and 15*b* of the half-wave voltage doubler circuit 15, and the same high-voltage V2 phase-shifted of 180 electrical degrees, is provided to terminals 16*a* and 16*b* of the half-wave voltage doubler 16.

As can be seen in the exemplary embodiment illustrated in FIGS. 2 and 5, the unidirectional conducting device 31 and the unidirectional conducting device 28 are further configured to be conducting during the half-period W1 of the alternating high-voltage V2, in order to cause, during these half-period W1, the high voltage capacitor 25 to be charged to the amplitude of the high voltage V2, and a double voltage DVH presents between the junctions 21 and 24 to be supplied to the first magnetron 8*a*. As can be seen in the exemplary embodiment illustrated in FIGS. 2 and 6, the unidirectional conducting device 32 and the unidirectional conducting device 23 are configured to be conducting during the half-periods W2 of the alternating high-voltage V2, which is in counter-phase with respect to the half-period W1, in order to cause, during these half-periods W2, the high voltage capacitor 19 of the first half-wave voltage doubler circuit 15 to be charged to the amplitude of the high voltage V2, and the double voltage DVH presents between the junctions 27 and 29 of the second half-wave voltage doubler circuit 16 to be supplied to the second magnetron 8*b*.

Hereinafter, it will be disclosed the operating of the high voltage control circuit 9 wherein it will be supposed that at the beginning of a voltage cycle in sine wave graph illustrated in FIGS. 5 and 6, both capacitors 19 and 25 are discharged, and the secondary high-voltage winding 13*b* provides a high voltage V2, for example of 2200 V.

During the positive-cycle, i.e. the first half-period, which is designed as W1 on the sine wave graph illustrated in FIG. 5, the voltage V2 from the secondary high-voltage winding 13*b* increases accordingly with the polarity illustrated.

On such half-period W1, the unidirectional conducting device 28 is on (it is conducting), the unidirectional conducting device 32 is off (it is not conducting), whereas the unidirectional conducting device 31 is on (it is conducting) and the unidirectional conducting device 23 is off (it is not conducting). Thus the current flows through the unidirectional conducting device 28 of the second half wave doubler circuit 16 in order to charge the high voltage capacitor 25 as illustrated in FIG. 5.

During the high voltage capacitor 25 charging time there is not voltage to the second magnetron 8*b* because, on one hand, the unidirectional conducting device 32 is off and, on the other hand, the current generated by secondary high-voltage winding 13*b* swings up through the unidirectional conducting device 28. The voltage across the capacitor 25 will rises with the voltage of the secondary high-voltage winding 13*b* to the high voltage value, e.g. of 2200 V having the polarity illustrated in FIG. 5.

When the high voltage V2 swings into the negative half wave during the second half-period, which is designed as W2 on the sine wave graph illustrated in FIG. 6, the unidirectional conducting device 28 is off (it is not conducting), the unidirectional conducting device 32 is on (it is conducting), the unidirectional conducting device 31 is off (it is not conducting) and the unidirectional conducting device 23 is on (it is conducting).

Since the unidirectional conducting devices 23 and 31 are on and off, respectively, the current flows through the unidirectional conducting device 23 in order to charge the high voltage capacitor 19.

Thus, during the second half-period W2, the voltage across the capacitor 19 will rise with the voltage of the secondary high-voltage winding 13*b* to the high voltage value, e.g. of 2200 V having the polarity illustrated in FIG. 6. Also, during the second half-period W2, the high voltage V2 from the secondary high-voltage winding 13*b* and the voltage across the capacitor 25 of the second half-wave doubler circuit 16 have the same polarities so that the secondary high-voltage winding 13*b* and the charged capacitor 25 operate as two energy sources in series. Thus the voltage V2=2200 V across the secondary high-voltage winding 13*b* adds the high voltage VC2=2200 stored in the capacitor 25 and the sum voltage DHV=V2+VC2=5400V, which is a doubled high voltage, is supplied to the cathode TC2 of the second magnetron 8*b*.

Since the unidirectional conducting device 28 operates as a rectifier, the doubled high voltage supplied to the second magnetron 8*b* during the second half-period W2 is a DC voltage.

During the second half-period W2, there is no voltage to the first magnetron 8*a* because, on one hand, the unidirectional conducting device 31 is off and, on the other hand, the current generated by secondary high-voltage winding 13*b* swings up through the unidirectional conducting device 23 in order to charge the capacitor 19.

When the high voltage swings again into the positive half-wave during the first half-period W1, the unidirectional conducting device 28 is on, the unidirectional conducting device 32 is off, the unidirectional conducting device 31 is on, and the unidirectional conducting device 23 is off.

Therefore, during the first half-period W1, the high voltage from the secondary high-voltage winding 13*b* and the voltage across the capacitor 19 of the first half-wave doubler circuit 15 have the same polarities so that the secondary high-voltage winding 13*b* and the capacitor 19 charged during the second half period W2, operate as two energy sources in series. Thus the voltage V2=2200 V across the secondary high-voltage winding 13*b* adds the high voltage VC2=2200 stored in the capacitor 19 and the sum voltage DVH="V2+VC2=5400V, which is a doubled high voltage, is supplied to the cathode TC1 of the first magnetron 8*a*. Since the unidirectional conducting device 23 operates as a rectifier, the doubled high voltage supplied to the first magnetron 8*a* during the first half-period W1 is a DC voltage.

Thanks to such connection of the unidirectional conducting devices 31 and 32 between the terminals T1 and T2 of the secondary high-voltage winding 13*b* and terminals 30, 33 having the ground potential VGND, capacitors 19 and 25 can be charged alternately during the respective half-periods so that magnetrons 8*a*,8*b* are powered-on alternately. Applicant has found that if the magnetrons 8*a* and 8*b* are powered-on alternatively, in counter phase, i.e. during the respective half-periods of the main period of the alternating supplying voltage, instantaneous power peaks generated in the heating chamber 7 are reduced (average power is maintained) thus causing a substantial reduction of electrical discharges in the heating chamber.

Furthermore, the present invention is particularly convenient when used in combined cooking/heating appliances because it is able to provide, at the end of a predetermined cooking-time, the same amount of heat energy provided by the known cooking/heating appliances, without however causing the generation of high power peaks.

Indeed, since in a voltage period, the magnetrons operate alternately in the half-periods, i.e. the first magnetron operates during a half-period and the second magnetron operates during the other half-period, the overall amount of heat energy generated in the heating chamber during a voltage period is equal to the amount of heat energy provided during a single half-period by means of the known solution.

However in the present solution the power density during a voltage period is highly reduced because magnetrons are activated alternately during half-periods, and not simultaneously as in the known solutions.

Thus the present invention provides a cooking/heating appliance which has the same cooking/heating performance of the known appliances in terms of cooking/heating time, but without the drawback of power peaks.

Figure 7:
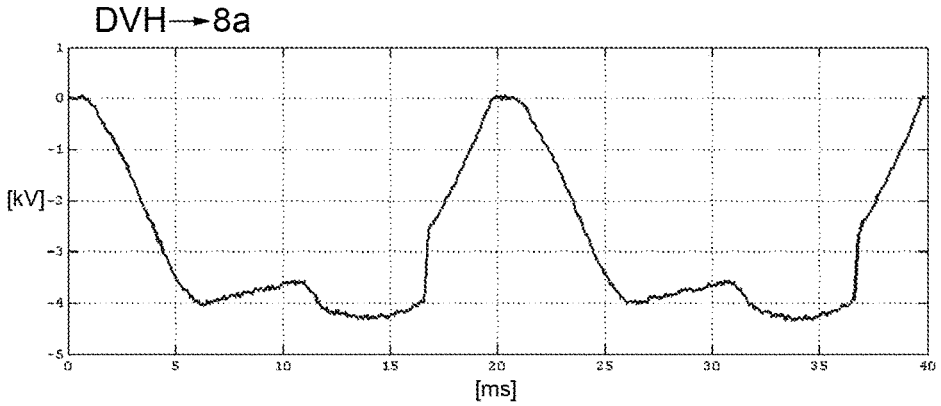
FIGS. 7 and 8 illustrate two graphs of the voltages supplied to the first and the second magnetrons, respectively, in an appliance according to the present invention.
Figure 8:
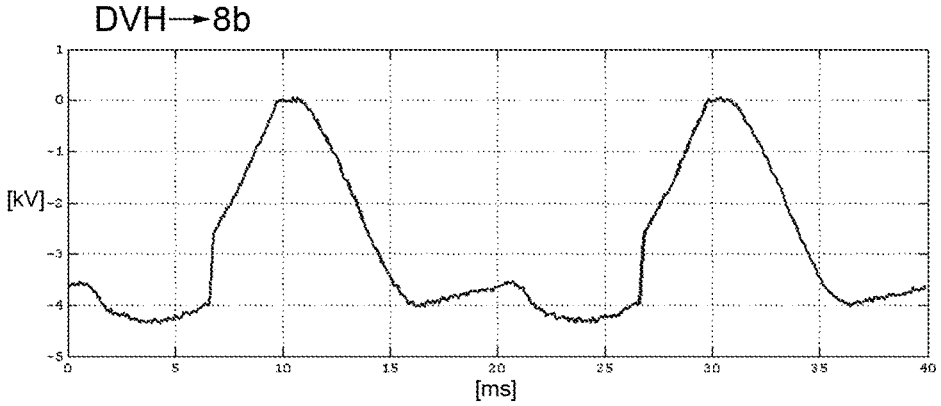

FIGS. 7 and 8 illustrate some results of a laboratory test made by Applicant, wherein FIG. 7 shows the doubled voltage DVH supplied to the magnetron 8*a* during the half-period W1, whereas FIG. 8 shows the doubled voltage DVH supplied to the magnetron 8*b* during the half-period W2.

Figure 9:
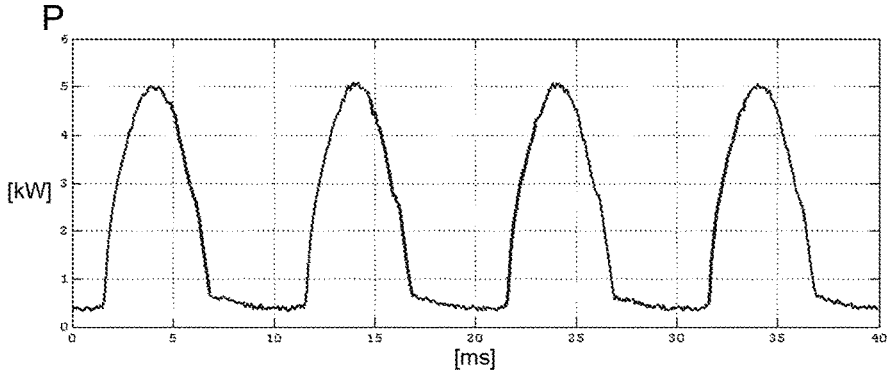
FIG. 9 illustrates a graph of the power being irradiated into the heating cavity of a microwave food cooking/heating appliance according to the present invention.

FIG. 9 is a graph that Applicant has obtained during the laboratory test, wherein it is illustrated the power provided to the cooking/heating chamber of the cooking/heating appliance made according to the present invention. It is worth to point out that graph shown in FIG. 9 has been obtained by an indirect measure of the currents that, during the half-periods, flow through the magnetrons 8*a* and 8*b*.

In detail, power P graph of FIG. 9 is obtained by the equation:

$$P=\mathrm{DVH1}*I1+\mathrm{DVH2}*I2.$$

Wherein: DVH1 is the double voltage measured between the cathode of the first magnetron 8*a* and the ground; DVH2 is the double voltage measured between the cathode of the second magnetron 8*b* and the ground; I1 is the current that flows through the first magnetron 8*a*; I2 is the current that flows through the second magnetron 8*b*.

As illustrated in the graph P of FIG. 9, even if the root mean square of the density power in the heating chamber 7 remains high, i.e. as in the known solution, the peaks of power P in the heating chamber are conveniently downed by half.

With reference to the embodiment illustrated in FIG. 4, the high voltage control circuit 9 may further comprise current sensing devices 34 and 35, which are configured to provide respective electric signals S1 and S2 which are indicative of the charging status of the capacitors 19 and 25 respectively.

The control unit 12 may be configured in order to: receive the electric signals S1 and S2, determine the charging status of the capacitors 19 and 25 based on the electric signals S1 and S2, and diagnose/detect whether magnetron 8*a* and/or the magnetron 8*b* are correctly supplied by the doubled high voltage DVH based on determined charging status of the capacitors 19 and 25. Advantageously, control unit 12 may be configured to detect whether the doubled high voltages DVH supplied to the magnetron 8*a* and/or the magnetron 8*b* is incorrect, based on charging status of the capacitors 19 and 25.

With reference to the exemplary embodiment illustrated in FIG. 4, the current sensing device 34 is advantageously connected in series to the unidirectional conducting device 31 in order to measure/sense the current that flows from the junction 26 to the terminal 30 during the half-period W1, and outputs the electric signal S1 indicating the measured current; the current sensing devices 35 is connected in series to the unidirectional conducting device 32 in order to measure/sense the current that flows from the junction 20 to the terminal 33 during the half-period W2, and outputs the electric signals S2 indicating the measured current.

With reference to the embodiment illustrated in FIG. 4, the high voltage control circuit 9 may further advantageously comprise at least an over-current protecting device 36, i.e. a fuse, which is preferably connected between at least a terminal T1 or T2 of the secondary high-voltage winding 13*b* and the junction 20 or 26, respectively. The over-current protecting device 36 may comprise a fuse which may be dimensioned with a rated current higher than the operating current, providing a wide margin to avoid undesired intervention of the fuse. Indeed, the short-circuit current may be very close to normal operating current. However to ensure intervention, the rated current of protection fuse may be set close to the normal operating current.

Preferably, the fuse may be configured so that its continuous current rating I_fuse may be set according to the following equation $$I_fuse=1.5*I_peak$$

wherein I_peak is the peak of the current that high voltage control circuit 9 supplies to the cathode of magnetrons in normal operating condition. It is point out that, in case of faults, the short circuit currents are much larger than the normal operating currents. Applicant has found that the fuse having a rated current higher than the peak of the normal operating current, on the one hand, ensures the intervention of the fuse in case of short circuit, and on the other hand, avoids undesired intervention.

Figure 10:
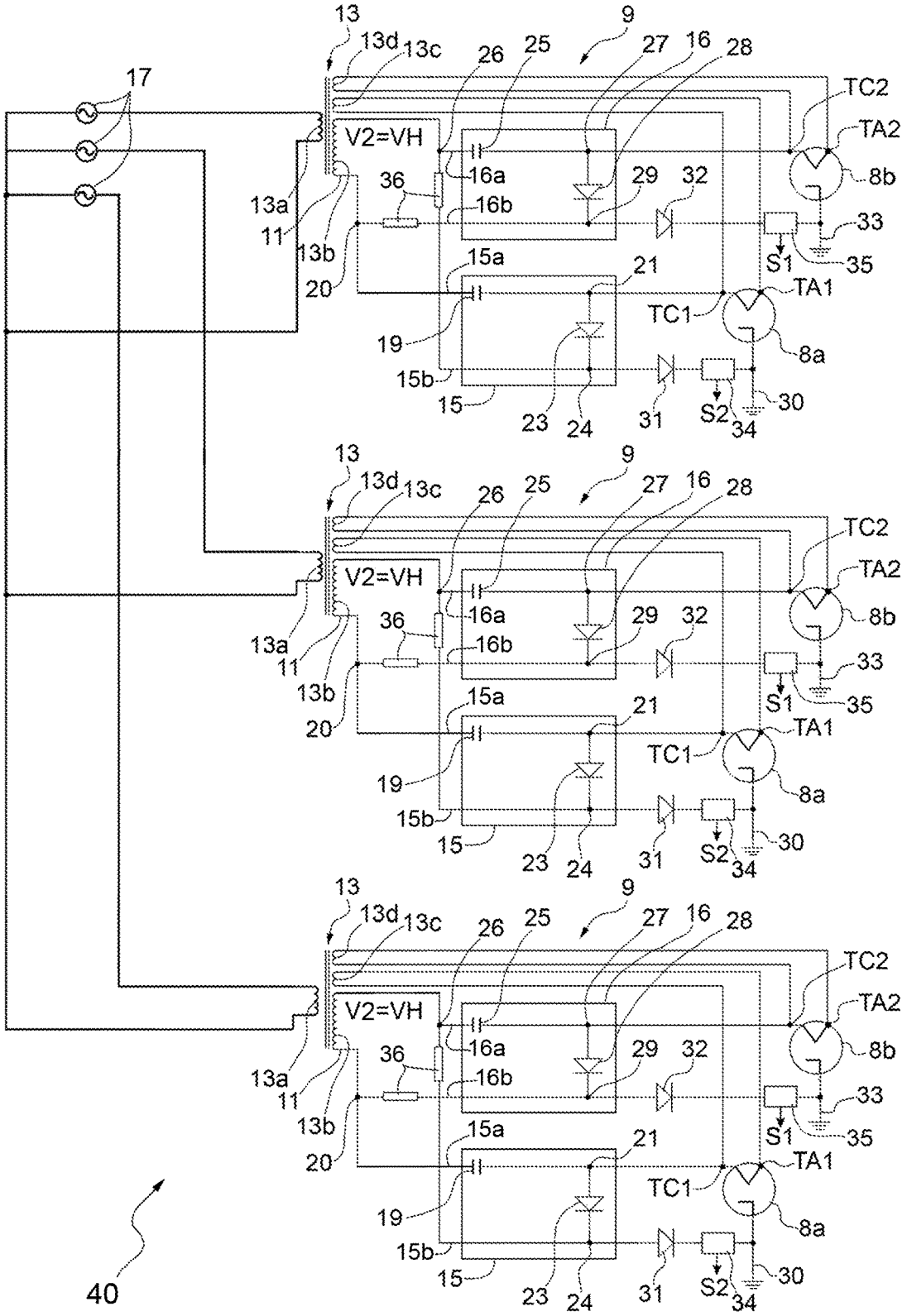
FIG. 10 illustrates a further advantageous embodiment of the high voltage control circuit according to the present invention.

The advantageous embodiment shown in FIG. 10 relates to an electrical power unit 40, which is similar to the electrical power unit 5, the component parts of which will be indicated, where possible, with the same reference numbers which identify corresponding parts of the electrical power unit 5.

The electrical power unit 40 differs from the electrical power unit 5 because it comprises three high voltage control circuits 9, each substantially identical to high voltage control circuits 9 described with reference to FIGS. 4, 5 and 6, each of which energizes two magnetrons 8*a*,8*b* alternately on the basis of respective half-periods of an alternating voltage according to what above disclosed. It is pointed out that electrical power unit 40 is configured to operate in a three-phase household or commercial appliance.

Figure 11:
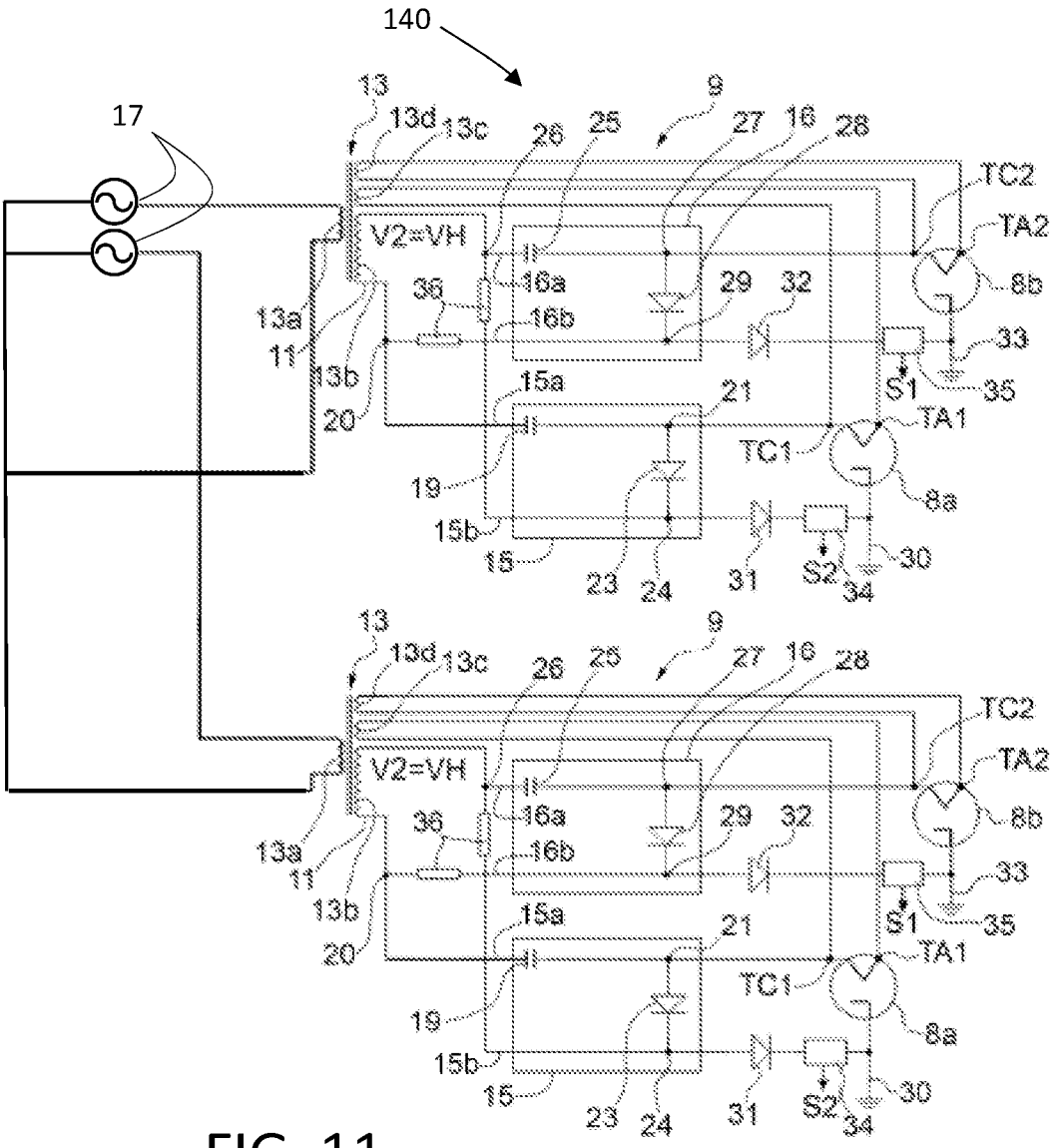
FIG. 11 illustrates a further advantageous embodiment of the high voltage control circuit according to the present invention.

In a further advantageous embodiment, illustrated in FIG. 11, only two couples of magnetrons 8*a*, 8*b* can are provided; in this embodiment, the component parts will be indicated, where possible, with the same reference numbers which identify corresponding parts of the electrical power unit 5. In this advantageous embodiment, an electrical power unit 140 is configured to supply high voltage to the magnetrons 8*a*, 8*b*; this electrical power unit 140 is similar to the electrical power unit 5, and it differs from the electrical power unit 5 because it comprises two high voltage control circuits 9, each substantially identical to high voltage control circuits 9 described with reference to FIGS. 4, 5 and 6, each of which energizes two magnetrons 8*a*, 8*b* alternately on the basis of respective half-periods of an alternating voltage according to what above disclosed. It is pointed out that in this case the electrical power unit 140 is configured to operate in a two-phase household or commercial appliance.

Figure 12:
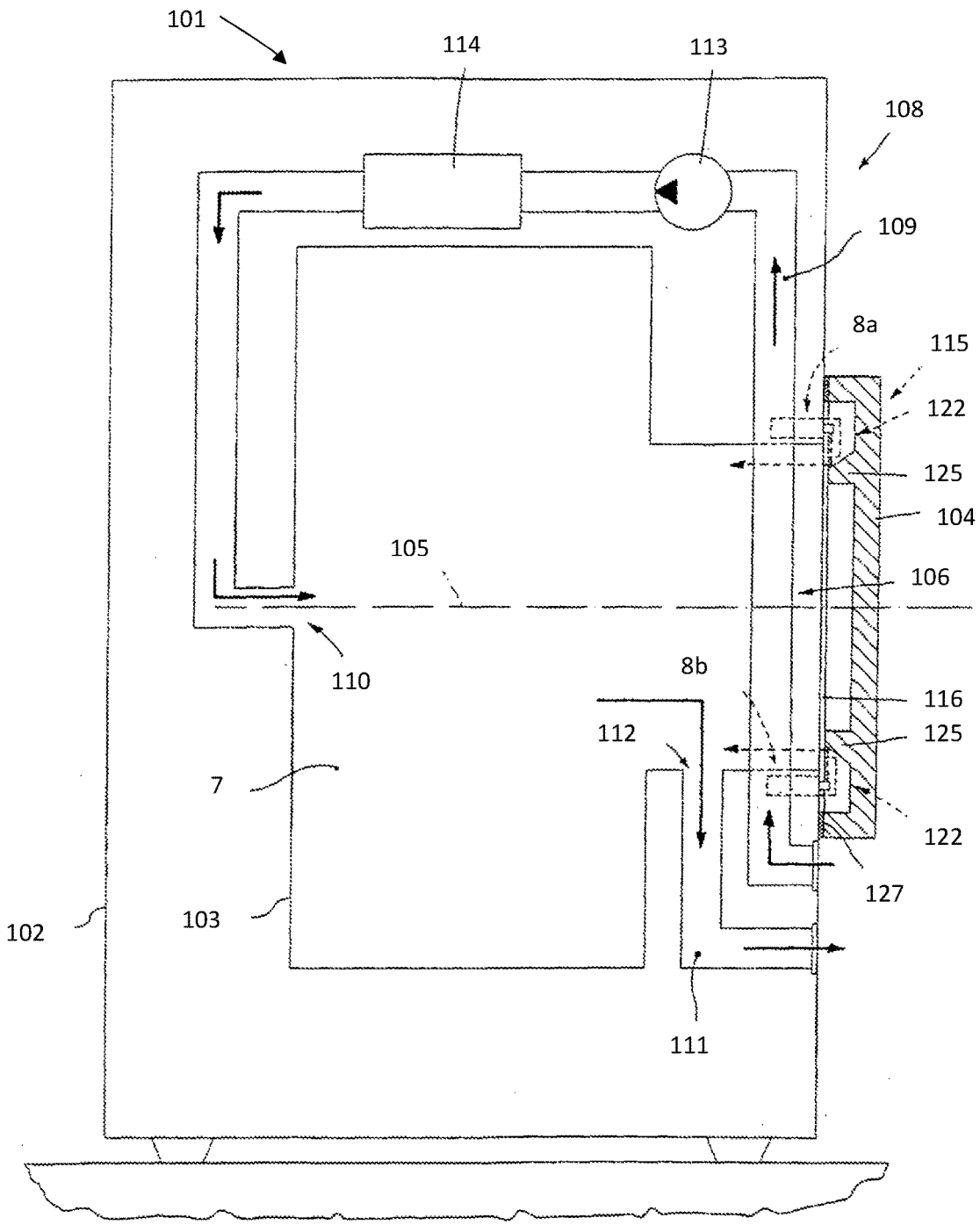
FIG. 12 shows a schematic side view of a microwave laundry drier in accordance with a further embodiment of the present invention.
Figure 13:
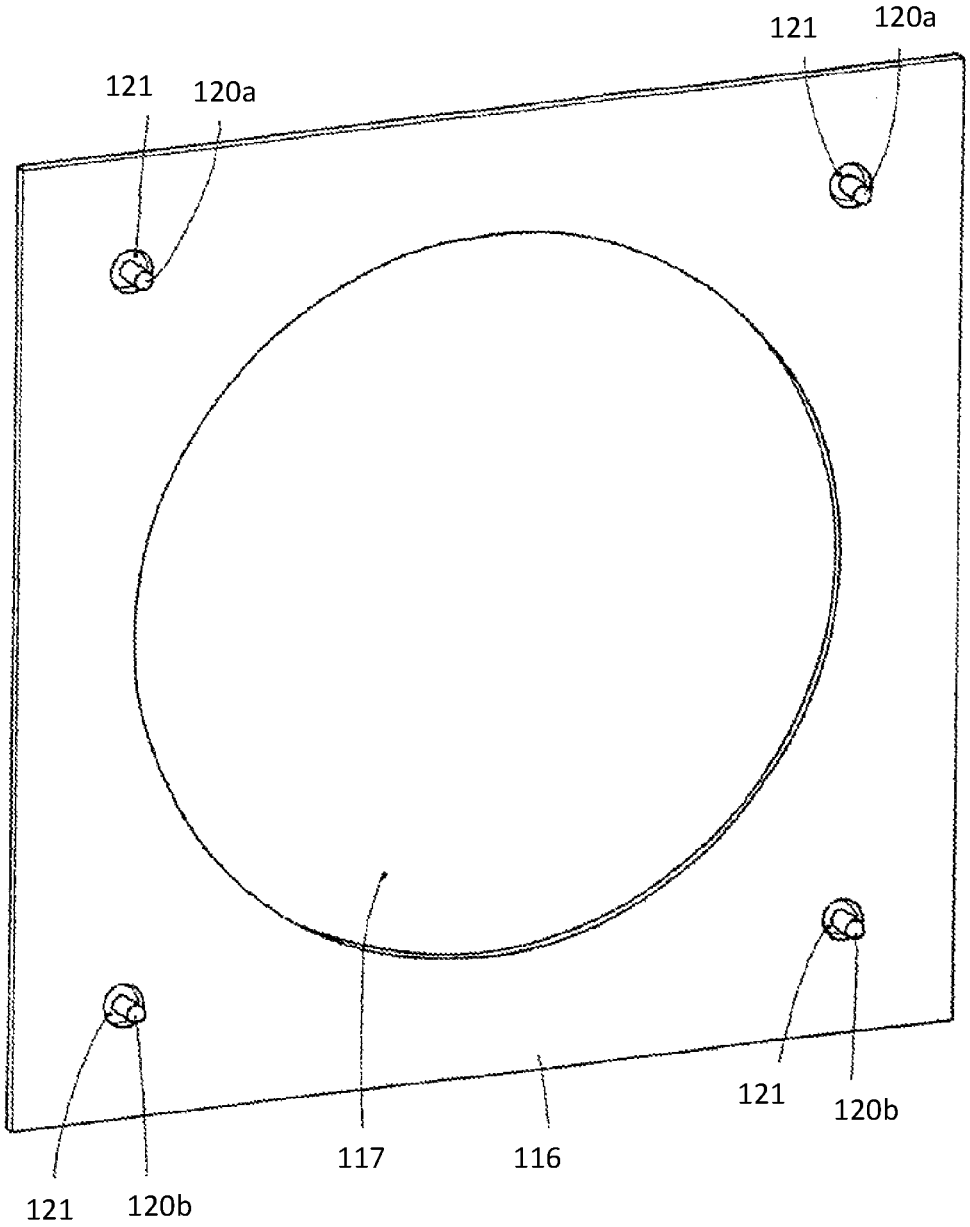
FIG. 13 shows a view in perspective of a front panel of the FIG. 12 microwave laundry drier.

Another advantageous embodiment of a household or commercial appliance according to the invention is illustrated in FIGS. 12 and 13, in which the household or commercial appliance is a microwave laundry drier 101, comprising a casing 102 resting on a floor on a number of feet. Casing 102 supports a revolving laundry drum 103 which defines a heating chamber 7, which in this case is a drying chamber, rotates about a horizontal rotation axis 105 (in alternative embodiments not shown, rotation axis 105 may be tilted or vertical), and has a front access opening 106 closed by a door 104 hinged to a front wall of casing 102. Drum 103 is rotated by an electric motor (not shown), and is fed through with a stream of drying air fed into drum 103 by a ventilation system 108 (that can be of the exhaust-type, like in FIG. 12, i.e. in which the hot drying air from drum 103 is exhausted directly into the external environment, or of the recirculation type, i.e. in which air exiting the drum 103 is re admitted in the latter after having being dehumidified and re-heated).

In the advantageous embodiment of FIG. 12, ventilation system 108 advantageously comprises an air intake conduit 109 for drawing in outside air, heating the air, and feeding the hot drying air into drum 103 through an inflow opening 110; an air exhaust conduit 111 for exhausting the moist, hot drying air from the drum to the outside through an outflow opening 112; and a centrifugal fan 113 and a heating device 114 located along air intake conduit 109.

It should be pointed out that the arrangement of ventilation system 108 is referred to, here, purely by way of example in connection with one embodiment of the present invention, and may be different. For example, ventilation system 108 may comprise a condenser located along air exhaust conduit 111 1 to condense the vapour in the stream of moist, hot air from drum 103, and at least part of the dry air from the condenser may be fed back into air intake conduit 109.

Microwave laundry drier 101 comprises a microwave energy source 115 for directing microwave energy to drying chamber 7. As shown in FIGS. 12 and 13, microwave energy source 115 is advantageously fixed to a front panel 116, which is supported by casing 102 (in particular, it may preferably form part of, or be fixed to, casing 102) and has a central opening 117 coaxial to front access opening 106 of drying chamber 7. Microwave energy source 115 advantageously comprises two couples of magnetrons 8*a*, 8*b*, preferably arranged symmetrically around central opening 117 in front panel 116 and advantageously fixed (screwed) to the back of front panel 116 to prevent microwave leakage inwards of casing 102.

Each magnetron 8*a*, 8*b* has preferably a magnetron antenna 120*a*, 120*b*, which emits the microwave energy and is located outside casing 102 through a hole 121 in front panel 116.

Microwave energy source 115 preferably comprises, for each magnetron 8*a*, 8*b*, a waveguide device 122 to guide the microwaves towards drying chamber 104. Each waveguide device 122 preferably also comprises a deflector 125, which is supported by door 104 and is designed to direct the microwaves towards drying chamber 104.

In the preferred embodiment shown in FIG. 12, air intake conduit 109 is connected to microwave energy source 115 so that at least part of the drying air flows past microwave energy source 115 to transfer heat from microwave energy source 115 to the drying air. More specifically, the fresh drying air (i.e. the drying air from outside, not yet heated by heating device 114) flows past magnetrons 8*a*, 8*b* to cool them and, at the same time, preheat the fresh drying air upstream heating device 114 (which, of course, is located downstream microwave energy source 115).

As shown in FIG. 12, microwave laundry drier 101 preferably comprises an annular reflecting element 127 surrounding central opening 117 in front panel 116 to form a microwave barrier. In In the advantageous embodiment illustrated in FIGS. 12 and 13, each couple of magnetrons 8*a*, 8*b* is advantageously powered by a high voltage control circuit identical to the high voltage control circuit 9 illustrated in FIGS. 4 to 6.

In another advantageous embodiment, the two couples of magnetrons 8*a*, 8*b* can be advantageously powered by an electrical power unit, not illustrated in FIGS. 12 and 13, identical to electrical power unit 140 illustrated in FIG. 11. In a further advantageous embodiment, not illustrated, the household or commercial appliance is a laundry washing machine; in this case the heating chamber is a washing tub comprising a rotatable drum in which the laundry is loaded. The washing tub is advantageously arranged for receiving washing/rinsing water, and one or more couple of magnetrons according to the invention, configured as the couples of magnetrons described above with reference to FIGS. 4 to 11 (there being the possibility of having a single couple, two couples, three couples or more couples of magnetron), are provided in order to heat the washing/rinsing water and or directly the laundry contained in the rotatable drum. It has thus been shown that the present invention allows all the set objects to be achieved.

In fact, the present invention is able to provide, at the end of a predetermined heating-time, the same amount of heating energy provided by the known heating appliances, without however causing the generation of high power peaks.

Indeed, since in a voltage period, the magnetrons operate alternately in the half-periods, i.e. the first magnetron operates during a half-period and the second magnetron operates during the other half-period, the overall amount of heating energy generated in the heating chamber during a voltage period is equal to the amount of heating energy provided during a single half-period by means of the known solution.

However in the present solution the power density during a voltage period is highly reduced because magnetrons are activated alternately during half-periods and not simultaneously as in the known solutions.

Accordingly, if on one hand, the overall power provided to the body to be heated (e.g. food, water, laundry) during the voltage period is equal to power generated in a half period by the known heating appliances, on the other hand, the overall power is conveniently divided in two half-periods by the present invention, thus power peaks are highly reduced.

Thus the present invention provides a heating appliance which has the same heating performance of the known appliances in terms of heating time, but without the drawback of power picks.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A household or commercial appliance (1, 101) comprising:

a heating chamber (7) designed to accommodate a product to be heated, at least a couple of magnetrons (8*a*)(8*b*) having relative anodes (TA1)(TA2) and cathodes (TC1)(TC2) and being configured to generate and irradiate electromagnetic radiation in the heating chamber (7), at least a power unit (5, 40, 140) comprising at least a high voltage circuit (9) configured to power-on said magnetrons (8*a*)(8*b*), wherein said high voltage circuit (9) comprises:

a high voltage transformer (13) comprising a primary winding (13*a*) connected to an alternating voltage source (17) and at least a secondary high-voltage winding (13*b*) providing an alternating high voltage (V2) having a period (W) comprising two half periods (W1)(W2), at least a couple of half-wave voltage doubler circuits (15)(16) which are configured to cooperate with said secondary high-voltage winding (13*b*) in order to provide a doubled high-voltage (DVH), at least a first and second unidirectional conducting devices (31)(32) which are connected respectively between said half-wave voltage doubler circuits (15)(16) and a reference terminal (30)(33) having a predetermined potential (GND), said first and second unidirectional conducting devices (31)(32) being configured to cause said half-wave voltage doubler circuits (15)(16) to supply, during at least a period (W) of said alternating high-voltage (V2), said doubled high-voltage (DVH) to the cathode (TC1)(TC2) of the respective magnetron (8a)(8b) alternately, one of said half-wave voltage doubler circuits (15) supplying said doubled high-voltage (DVH) during one of said half periods (W1) of said alternating high-voltage (V2), and the other half-wave voltage doubler circuit (16) supplying said doubled high-voltage (DVH) during the other half-period (W2) of said alternating voltage (V2).

2. The household or commercial appliance according to claim 1, wherein:

said half-wave voltage doubler circuits (15)(16) comprise respective high voltage capacitors (19)(25);

said first and second unidirectional conducting devices (31)(32) being configured to cause the high voltage capacitors (19)(25) to be alternately charged; one said high voltage capacitor (19) being supplied during one of said half periods (W2) and the other said high voltage capacitor (25) being supplied during the other half-period (W1).

3. The household or commercial appliance according to claim 1, wherein:

a first high voltage capacitor (19) of a first half-wave voltage doubler circuit (15) has a first terminal connected through a first junction (20) to a first terminal (T1) of the secondary high-voltage winding (13*b*) and a second terminal connected through a second junction (21) to the cathode terminal (TC1) of a first of said magnetrons (8*a*);

a second high voltage capacitor (25) of the second half-wave voltage doubler circuit (16) has a first terminal connected through a third junction (26) to a second terminal (T2) of the secondary high-voltage winding (13*b*), and a second terminal connected through a fourth junction (27) to the cathode (TC2) of a second of said magnetrons (8*b*).

4. The household or commercial appliance according to claim 3, wherein:

said first half-wave voltage doubler circuit (15) further comprises a third unidirectional conducting device (23), which has an anode terminal connected to the second junction (21) and a cathode terminal which is connected through a fifth junction (24) to said second terminal (T2) of the secondary high-voltage winding (13*b*);

said second half-wave voltage doubler circuit (16) further comprises a fourth unidirectional conducting device (28), which has an anode terminal connected with the fourth junction (27) and a cathode terminal which is connected through a sixth junction (29) with said first terminal (T1) of the secondary high-voltage winding (13*b*).

5. The household or commercial appliance according to claim 4, wherein:

said first unidirectional conducting device (31) has an anode terminal connected to the fifth junction (24) and a cathode terminal connected to said reference terminal (30) being kept at said predetermined potential (VGND);

said second unidirectional conducting device (32) has an anode terminal connected to the sixth junction (29) and a cathode terminal connected to said reference terminal (33) being kept at said predetermined potential (VGND).

6. The household or commercial appliance according to claim 5, wherein the first unidirectional conducting device (31) and the fourth unidirectional conducting device (28) are configured to be conducting during first half-periods (W1) of said alternating high-voltage (V2), in order to cause, during said first half-periods (W1), the second high voltage capacitor (25) of the second half-wave voltage doubler circuit (16) to be charged to the amplitude of said alternating high-voltage (V2), and a double voltage (DVH) between the second junction (21) and fifth junction (24) to be supplied to the first magnetron (8*a*).

7. The household or commercial appliance according to claim 5, wherein the second unidirectional conducting device (32) and the third unidirectional conducting device (23) are configured to be conducting during second half-periods (W2) of said alternating high-voltage (V2), in order to cause, during said second half-periods (W2), the first high voltage capacitor (19) of the first half-wave voltage doubler circuit (15) to be charged to the amplitude of said alternating high-voltage (V2), and the double voltage (DHV) between the fourth junction (27) and sixth junction (29) to be supplied to the second magnetron (8*b*).

8. The household or commercial appliance according to claim 3, wherein the high voltage control circuit (9) comprises:

at least first (34) and second (35) current sensing devices, which are configured to provide respective electric signals (Si) and (S2) indicative of the charging status of the second capacitor (25) and first capacitor (19) respectively;

a control unit (12) configured in order to: receive the electric signals (S1)(S2), determine the charging status of the second (25) and of the first capacitor (19) based on the received electric signals (S1)(S2), and diagnose/detect whether first magnetron (8*a*) and/or the second magnetron (8*b*) are correctly supplied with the doubled high voltage (DVH) based on determined charging status of the first capacitor (19) and second capacitor (25).

9. The household or commercial appliance according to claim 8, wherein said first current sensing device (34) is connected in series to the first unidirectional conducting device (31) in order to measure/sense the current that flows from the third junction (26) to the reference terminal (30) during a first half-cycle (W1) of said alternating high-voltage (V2), and outputs said electric signal (S1) indicating the measured current;

a second current sensing devices (35) is connected in series to the second unidirectional conducting device (32) in order to measure/sense the current that flows from the first junction (20) to the reference terminal (33) during a second half-wave (W2) of said alternating high-voltage (V2), and outputs said electric signals (S2) indicating the measured current.

10. The household or commercial appliance according to claim 3, wherein the high voltage control circuit (9) comprises at least an over-current protecting device (36), which is connected between said first terminal (T1) of the secondary high-voltage winding (13*b*) and said first junction (20), or between the second terminal (T2) and said third junction (26).

11. The household or commercial appliance according to claim 1 comprising:

two or more couples of magnetrons (8*a*)(8*b*) having relative anodes and cathodes and being configured to generate and irradiate electromagnetic radiations in the cooking/heating chamber (7);

the power unit (5, 40, 140) comprising two or more high voltage circuits (9); each high voltage circuit (9) being configured to power-on the two magnetrons (8*a*)(8*b*) of one of said two or more couples of magnetrons (8*a*)(8*b*) alternately to each other.

12. The household or commercial appliance according to claim 1 comprising: a base member (2) comprising a food-support surface (3), which is adapted to support food products to be cooked/heated and an upper member (4) associated to a top heating surface (6) and joined in an articulated manner to the base member (2) in order to be tilted/rotate around an horizontal axis (A) from an open position and a closed position, wherein the upper member (4) is displaceable towards the base member (2) and the top heating surface (6) comes to lie opposite to the food-support surface (3) so as to enclose the food products therebetween.

13. The household or commercial appliance according to claim 12, comprising: infrared radiation generating devices (11) configured to generate and irradiate, on command, infrared radiation in the heating chamber (7) across the food-support surface (3), resistive heating devices (10) configured to heat, on command, said top heating surface (6).

14. The household or commercial appliance according to claim 13, comprising a control unit (12) configured to control the microwaves generators (8*a*)(8*b*), the resistive heating devices (10) and the infrared radiation generating devices (11) based on a coking program selected by a user by means of a control panel (14).

15. The household or commercial appliance according to claim 1, wherein said half-wave voltage doubler circuits (15)(16) are connected to said secondary high-voltage winding (13*b*) one in counter phase with respect to the other.

* * * * *